US005255995A

United States Patent [19]

Branning

[11] Patent Number: 5,255,995

[45] Date of Patent: Oct. 26, 1993

[54] HIGHWAY REFLECTORS

[76] Inventor: Lester W. Branning, 2325 Ulmerton Rd., Ste. 16, Clearwater, Fla. 34622

[21] Appl. No.: 890,695

[22] Filed: May 29, 1992

[51] Int. Cl.[5] ..... F01F 11/00

[52] U.S. Cl. ..... 404/14

[58] Field of Search ..... 404/12, 13, 14; 40/608, 40/612

[56] References Cited

U.S. PATENT DOCUMENTS 3,971,623 7/1976 Hedgewick et al. ..... 404/12 X
5,002,424 3/1991 Hedgewick ..... 404/14
5,078,538 1/1992 Montalbano ..... 404/14 X

*Primary Examiner*—William P. Neuder
*Attorney, Agent, or Firm*—Dominik, Stein, Saccocio, Reese, Colitz & van der Wall

[57] ABSTRACT

A highway marker comprising an essentially horizontally positionable base having a lower face securable to the ground and an upper face thereabove and a generally rectangular periphery therebetween, the base also having tapering exterior walls with spaced parallel ribs extending downwardly from the lower face, the ribs being formed with thinner upper ends integral with the lower face and with thicker lower free ends; an essentially vertically extending body having a generally planar front face and a generally planar rear face defining a generally rectangular periphery with a free upper edge and a lower edge integrally formed with the upper face of the base, the body being thicker at its lower edge than its upper edge; a circular projection formed integrally with, and extending outwardly from, each face of the body to define a recess, the edge of each projection remote from its associated face extending radially inwardly to define a locking lip; a plurality of ribs formed integrally with, and extending outwardly from, each face of the body to strengthen the body, the ribs having a generally rectangular configuration and extending between the base and an associated projection; and a circular reflector positioned in each recess and held in position by an associated lip, each reflector being formed of a circular interior component and a circular exterior component, the exterior surface of the exterior component being reflective; the base, body, projections and ribs being molded integrally of a closed cell polyurethane foam at a temperature and time to create larger cells interiorly and smaller cells exteriorly whereby the exterior forms a hardened skin to ensure that the base maintains itself erect from the base during extended use and whereby the interior imparts a reduced weight to the reflector.

12 Claims, 3 Drawing Sheets

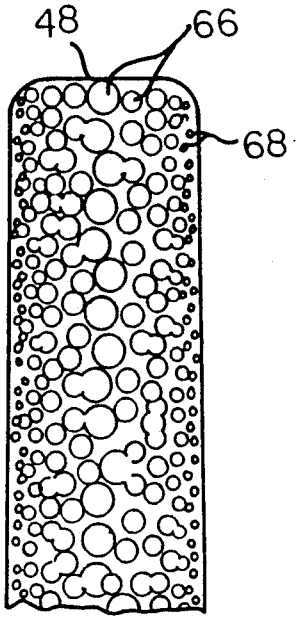
FIG. 6
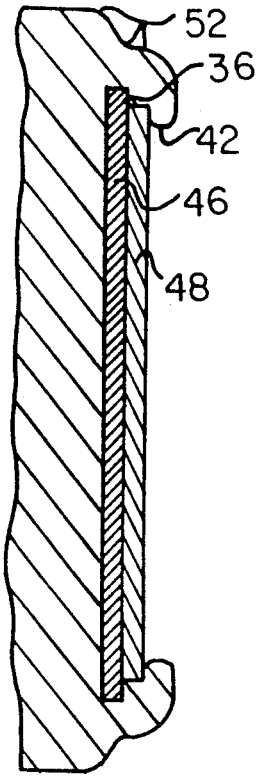
FIG. 5
FIG. 7
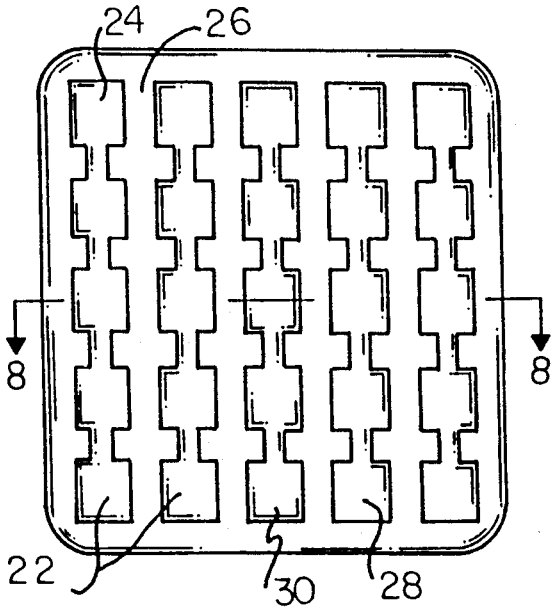
FIG. 8
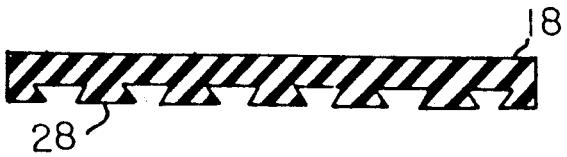

HIGHWAY REFLECTORS

FIELD OF THE INVENTION

The present invention relates to highway reflectors and, more particularly, to highway reflectors with vertical ribs extending from a base and constructed of an elastomer with its exterior denser than its interior.

DESCRIPTION OF THE BACKGROUND ART

Traffic congestion is a continual and growing problem in the United States and abroad. Consequently, methods for routing and controlling traffic are continuously being updated and reviewed. There are several types of traffic control devices. The most common are: (1) Raised, in-road reflectors. These are permanently-mounted into the road and they provide good nighttime visibility with virtually no daytime visibility. They are approximately 1 inch high. (2) Lane demarkation devices. These are rigid or mechanically-hinged and are greater than 36 inches in height. They are permanently mounted to deny access to an area of the road. (3) Cones. They provide good daytime visibility but poor nighttime visibility. They are used for temporary routing of traffic but cannot be readily secured in place. (4) Barricades. They are large physical barriers, usually temporary to deny access to an area of the road.

The traffic cone overcomes some of the drawbacks incurred by painted road markings. Traffic cones are simple to manufacture and can be readily transported. Yet, the traffic cone still has its limitations. Careless, and sometimes even careful drivers hit traffic cones causing them to move from their original location. Besides being moved, traffic cones frequently become damaged after being hit. More importantly, due to the size and structure of most traffic cones it is possible that automobiles can be damaged upon running over traffic cones. Still another drawback of traffic cones is their lack of visibility at night. Most traffic cones have no reflective surfaces and depend entirely upon their insufficient orange color to warn motorists. Despite all of the above-mentioned drawbacks with the present traffic control devices, they are still widely in use.

Several attempts have been made to improve upon the above mentioned traffic control devices. U.S. Pat. No. 2,520,236 to Carver; U.S. Pat. No. 2,525,728 to Sauer; U.S. Pat. No. 3,066,899 to Rossi and U.S. Pat. No. 3,161,720 to Musichuk all disclose traffic control devices which are similar to the present invention. However, these patents disclose devices which are substantially rigid in construction. Thus, if a vehicle were to pass over one of these devices, damage could occur to either the device or the vehicle.

U.S. Pat. No. 4,090,465 to Bell discloses a traffic control device which is similar to the present invention. However, the Bell device is of two piece construction and does not illustrate the use of large reflective regions, such as in the present invention. Further, such device dues not include vertical ribs extending from a base nor is it constructed of an elastomer with its exterior denser than its interior, features of the present invention.

Kaplan, in U.S. Pat. No. 3,913,518, discloses a traffic marker with a resilient column. The Kaplan device differs from the present invention in that it employs a resilient column instead of a resilient face portion. The use of a column greatly reduces the surface area upon which reflective markers can be placed. Further, such device dues not include vertical integral ribs extending from a base nor is it constructed of an elastomer with its exterior denser than its interior, features of the present invention.

U.S. Pat. No. 3,564,984 to Alexander discloses a highway marker which is of a two-piece construction. Furthermore, the Alexander device teaches that the delineator unit is designed to break away from the base upon impact from a vehicle. The subject invention is of a one-piece construction and is designed to remain that way after impact from a vehicle due to its reboundability. Further, such device does not include vertical ribs extending from a base nor is it constructed of an elastomer with its exterior denser than its interior, features of the present invention.

Kuhl, in U.S. Pat. No. 4,864,299, discloses a device which is battery operated, and therefore, quite different from the subject invention. Further, such device does not include vertical ribs extending from a base nor is it constructed of an elastomer with its exterior denser than its interior, features of the present invention.

U.S. Pat. No. 2,109,011 to Joyce discloses night road markers which are designed to be fitted into the roadway via stakes. The subject invention is designed to be placed upon the road surface and, therefore, is quite different from the Joyce device. Further, such device does not include vertical ribs extending from a base nor is it constructed of an elastomer with its exterior denser than its interior, features of the present invention.

United Kingdom Patent Number 2,223,786 to Myers et al discloses a device with a much more complex understructure than the subject invention. The Myers device employs a movable arm to retain the feet in their respective positions. The present invention is an improvement over the Myers device in that it employs no movable parts within the understructure. Further, such device does not include vertical ribs extending from a base nor is it constructed of an elastomer with its exterior denser than its interior, features of the present invention.

U.S. Pat. No. 4,462,711 to Garner discloses a reflective road marker which is somewhat similar to the subject invention. However, the Garner device requires the use of a display holder for use in holding reflective materials. The reflective materials are inserted through a slot and then an adhesive material is employed to seal the slot. The present invention is a improvement over the Garner device in that it requires no adhesive materials in affixing its reflective materials. Furthermore, the Garner device does not disclose the use of a ribbed understructure. Further, such device dues not include vertical ribs extending from a base nor is it constructed of an elastomer with its exterior denser than its interior, features of the present invention.

French Patent Number 1,235,337 to Neuhaus discloses a marking device similar in certain regards to the subject invention. Yet, the Neuhaus device does not employ the use of any strengthening ribs, neither between the face and base portion, or anywhere in the understructure of the device. Further, such device dues not include vertical ribs extending from a base nor is it constructed of an elastomer with its exterior denser than its interior, features of the present invention.

Although many such advances are made to one extent or another none achieves the objectives of an efficient, reliable, inexpensive, convenient to use apparatus for highway marking as set forth herein to accommodate traffic control.

As illustrated by the great number of prior patents and known commercial techniques, methods and devices, efforts are continuing in an attempt to control traffic more efficiently, reliably, inexpensively and conveniently. None of these previous efforts, however, provides the benefits attendant with the present invention. Additionally, prior techniques do not suggest the present inventive combination of component elements as disclosed and claimed herein. The present invention achieves its intended purposes, objectives and advantages over the prior art through a new, useful and unobvious combination of method steps and claimed components which is simple to use, with the utilization of a minimum number of functioning parts, at a reasonable cost to manufacturers, and by employing only readily available materials. Therefore, it is an object of this invention to provide a highway marker comprising an essentially horizontally positionable base having a lower face securable to the ground and an upper face thereabove and a generally rectangular periphery therebetween, the base also having tapering exterior walls with spaced parallel ribs extending downwardly from the lower face, the ribs being formed with thinner upper ends integral with the lower face and with thicker lower free ends; an essentially vertically extending body having a generally planar front face and a generally planar rear face defining a generally rectangular periphery with a free upper edge and a lower edge integrally formed with the upper face of the base, the body being thicker at its lower edge than its upper edge; a circular projection formed integrally with, and extending outwardly from, each face of the body to define a recess, the edge of each projection remote from its associated face extending radially inwardly to define a locking lip; a plurality of ribs formed integrally with, and extending outwardly from, each face of the body to strengthen the body, the ribs having a generally rectangular configuration and extending between the base and an associated projection; and a circular reflector positioned in each recess and held in position by an associated lip, each reflector being formed of a circular interior component and a circular exterior component, the exterior surface of the exterior component being reflective; the base, body, projections and ribs being molded integrally of a closed cell polyurethane foam at a temperature and time to create larger cells interiorly and smaller cells exteriorly whereby the exterior forms a hardened skin to ensure that the base maintains itself erect from the base during extended use and whereby the interior imparts a reduced weight to the reflector.

A further object of the invention is to strengthen highway markers through vertically extending ribs extending upwardly from a base.

A further object of the invention is to add rigidity to highway markers through the molding with an elastomer which is denser at its exterior surface than at its interior while retaining its flexibility and reboundability.

A further object of the invention to increase the performance of highway markers while decreasing their weight and cost.

A further object of the invention is to fabricate highway markers to ensure that they remain functional over a life of extended use and abuse.

A further object of the invention is to design highway markers with low profiles to minimize damage to vehicles which may strike such highway markers yet provide high visibility due to a large surface area.

The foregoing has outlined some of the more pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention may be incorporated into a highway marker comprising an essentially horizontally positionable base having a lower face securable to the ground and an upper face thereabove and a generally rectangular periphery therebetween, the base also having tapering exterior walls with spaced parallel ribs extending downwardly from the lower face, the ribs being formed with thinner upper ends integral with the lower face and with thicker lower free ends; an essentially vertically extending body having a generally planar front face and a generally planar rear face defining a generally rectangular periphery with a free upper edge and a lower edge integrally formed with the upper face of the base, the body being thicker at its lower edge than its upper edge; a circular projection formed integrally with, and extending outwardly from, each face of the body to define a recess, the edge of each projection remote from its associated face extending radially inwardly to define a locking lip; a plurality of ribs formed integrally with, and extending outwardly from, each face of the body to strengthen the body, the ribs having a generally rectangular configuration and extending between the base and an associated projection; and a circular reflector positioned in each recess and held in position by an associated lip, each reflector being formed of a circular interior component and a circular exterior component, the exterior surface of the exterior component being reflective; the base, body, projections and ribs being molded integrally of a closed cell polyurethane foam at a temperature and time to create larger cells interiorly and smaller cells exteriorly whereby the exterior forms a hardened skin to ensure that the base maintains itself erect from the base during extended use and whereby the interior imparts a reduced weight to the reflector.

The invention may also be incorporated into a highway marker comprising an essentially horizontally positionable base having a lower face and an upper face thereabove and a periphery therebetween, the base also having tapering exterior walls with spaced parallel ribs extending downwardly from the lower face; an essentially vertically extending body having a generally planar front face and a generally planar rear face defining periphery with a free upper edge and a lower edge integrally formed with the upper face of the base, the base being thicker at its lower edge than its upper edge; a projection formed integrally with, and extending outwardly from, each face of the body to define a recess, the edge of each projection remote from its associated face extending radially inwardly to define a locking lip; a plurality of ribs formed integrally with, and extending outwardly from, each face of the body to strengthen the body, the ribs extending between the base and an associated projection; and a circular reflector positioned in each recess and held in position by an associated lip, each reflector being formed of an interior component and an exterior component, the exterior surface of the exterior component being reflective.

The reflector has indicia on its exposed face. The lip covers at least about 0.200 inches of the periphery of the marker. The vertically-extending body portion is molded around the majority of the reflector.

Lastly, the invention may also be incorporated into a highway marker comprising an essentially horizontally base having a lower face and an upper face thereabove and a periphery therebetween, the base also having tapering exterior walls with spaced parallel ribs extending downwardly from the lower face; an essentially vertically extending body having a generally planar front face and a generally planar rear face defining a periphery with a free upper edge and a lower edge integrally formed with the upper face of the base, the base being thicker at its lower edge than its upper edge; a projection formed integrally with, and extending outwardly from, each face of the body to define a recess; a plurality of ribs formed integrally with, and extending outwardly from each face of the body to strengthen the body, the ribs extending between the base and an associated projection; and a reflector positioned in each recess, the exterior surface of the exterior component being reflective; the base, body, projections and ribs being molded integrally of a closed cell foam at a temperature and time to create larger cells interiorly and smaller cells exteriorly whereby the exterior forms a hardened skin to ensure that the base maintains itself erect from the base during extended use and whereby the interior imparts a reduced weight to the reflector. The base and body are compression molded. The base and body are molded of urethane. The base and body are molded with curved edges. The curved edges have a radius of curvature of at least about 0.250 inches. The foam is selected from the class of materials including EPDM, SBR and urethane. The foam is urethane.

The foregoing has outlined rather broadly, the more pertinent and important features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which:

FIG. 5 is a sectional view through the reflector, its substrate as well as the supporting vertical upper portion of the device.

FIG. 6 is a sectional view through the upper part of the vertical upper portion of the device.

FIG. 7 is a bottom view of the device of the prior Figures.

FIG. 8 is a sectional view through the bottom portion as shown in FIG. 7.

Similar numbers refer to similar parts throughout the various Figures.

DETAILED DESCRIPTION OF THE INVENTION

Figure 1:
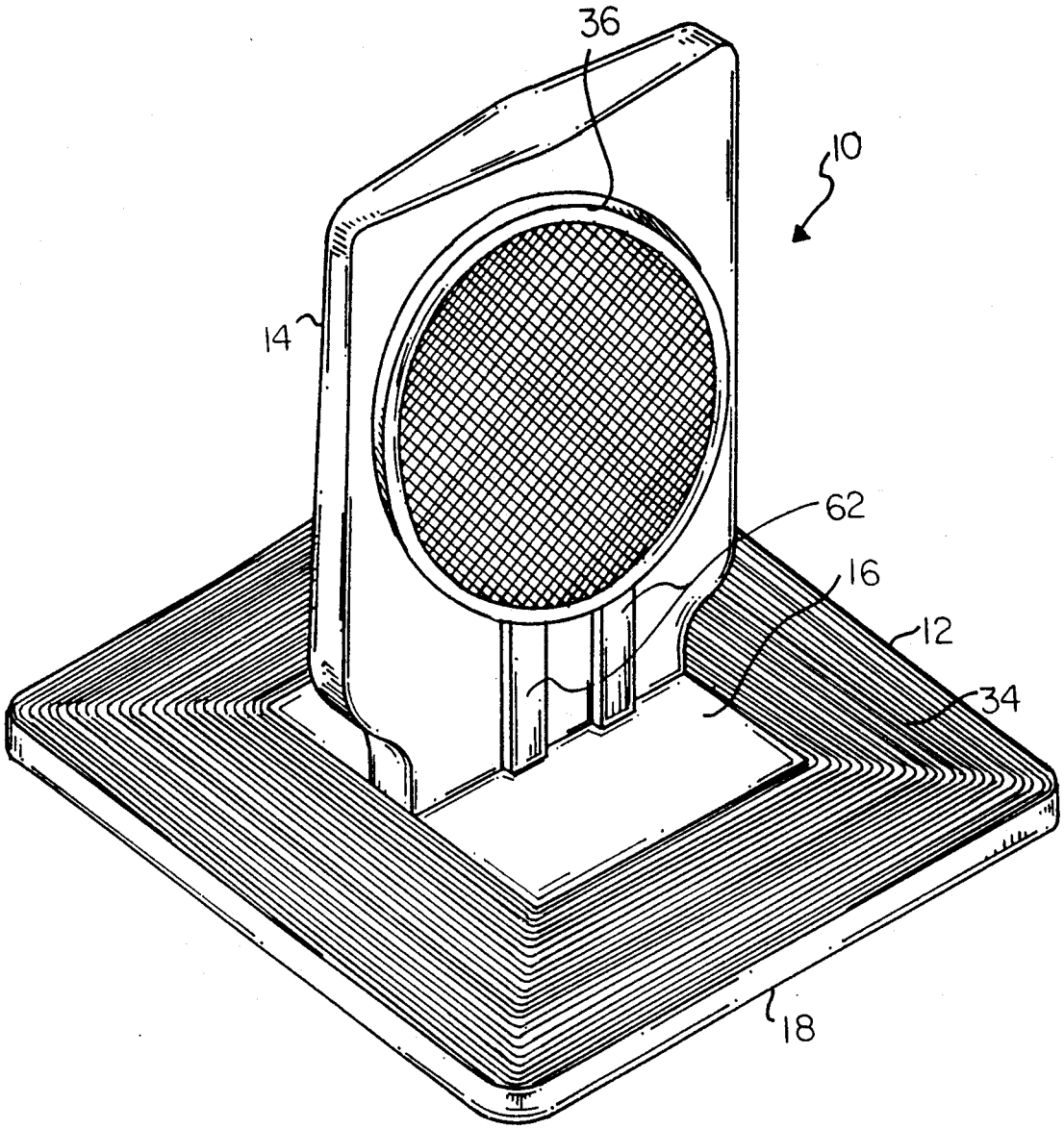
FIG. 1 is a perspective illustration of a highway reflector constructed in accordance with the principles of the present invention.

The highway reflector 10 of the present invention includes two major components, the base portion 12 and the face portion 14. The base portion includes an upper base section 16 and a lower base section 18. The lower base section is defined by a square horizontal bottom face and a square vertical upper face. The two faces define a narrow rectangular periphery which extends between them. This narrow rectangular periphery makes up the overall height of the lower base section. Square base provides easy alignment for correct placement of the reflecting surface to be perpendicular to oncoming traffic.

Integrally formed within the lower base section are five parallel ribs 22. Each of the parallel ribs is formed by a set of five generally square ribs 24 which are separated by four generally rectangular recesses 26. The parallel ribs extend from the bottom face up through the entire lower base section. The parallel ribs 22 are such that their alternate cross sections 28 and 30 are either parallel or taper outwardly from the bottom face up through the lower base section.

The base is of a waffle or honeycomb configuration with cavities which have negatively-sloped walls. This is contrary to known devices which have positively-sloped or vertical walls. The instant invention is superior because it provides a mechanical bond to the adhesive which adheres the product to the road surface.

The upper base section includes four inwardly tapering exterior walls 24, the front sloping wall, the right sloping wall, the rear sloping wall and the left sloping wall. The tapering of the walls terminates at the square top face 16 of the upper base section. Within the front sloping wall there is formed a front base aperture 36, and likewise within the rear sloping wall there is formed a rear base aperture 38.

The base apertures and are of the same geometric shape as the sloping walls but of a reduced dimension. Around the periphery of each of the base apertures are base edges 42. Front base edge extends around the periphery of front base aperture, while rear base edge extends around the periphery of rear base aperture. These base edges overhang their respective apertures and serve to create locking lip peripheries. These locking lip peripheries hold two surfaces within each of the base apertures. Within the front base aperture there is a front base substrate 44 over which is placed a front base reflective surface 46. Likewise, within the rear base aperture there is, preferably, a rear base substrate and a rear base reflective surface.

Extending vertically upward from the base portion is the face portion. The face portion consists of a planar front face and a planar rear face. These two planar faces serve to define a narrow rectangular band 48 which extends between them. The narrow rectangular band defines the depth of the face portion.

The face portion is substantially rectangular in shape throughout most of its length. However, the face portion tapers inwardly at its lower extent to meet with the square top face of the base portion. Additionally, all edges of the device are formed with slight bevels 52. It has been found that bevels or rounded edges are preferably formed at all corners and edges to preclude reduced rigidity of the skin of the molded material. Such edges have a radius of curvature of at least about 0.25 inches.

Centrally located, and formed integrally with the front face is front circular projection 56. Likewise, the rear face contains rear circular projection 56. The front circular projection serves to define a front face recess while the rear circular projection serves to define a rear face recess. Additionally, about the front circular projection there is a front peripheral edge which is remote from its associated face and which extends radially inward thereby aiding in protecting the reflective surface. Likewise, about rear circular projection there is a rear peripheral edge. These edges serve as locking lip peripheries. Each locking lip periphery retains two different materials within these respective face portions. In the front face recess there is a first front face substrate 44 which is similar to the substrate material found in the recesses of the base portion. Upon the front face substrate is placed a front face reflective surface 46. Likewise, within the rear face recess there is a rear face substrate and upon that is placed rear face reflective surface. The reflective surfaces can be such that they are in the form of a design such as an arrow or letter or other appropriate indicia 58.

The configuration of circular edges 42 with respect to the circular substrates 46 and reflectors 48 allow the rotation of the indicia within the device for a particular application. Further, since the substrates and reflectors are secured only by the edges, they may be readily replaced during use, and they may be positioned by placing the substrate and reflector in the mold prior to the molding process.

Figure 2:
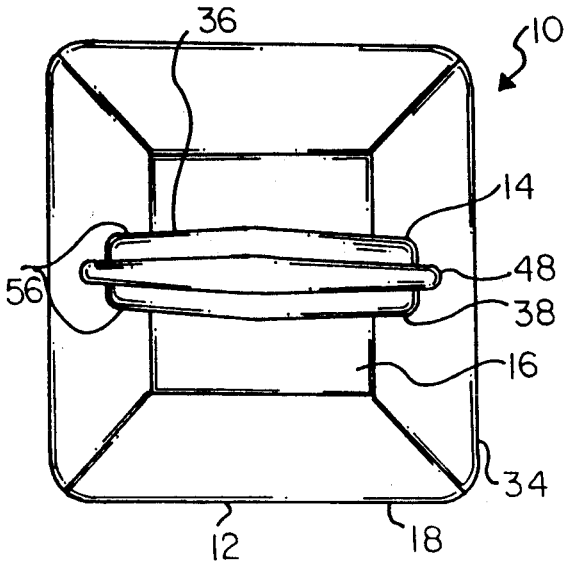
FIG. 2 is a plan view of the reflector shown in FIG. 1.
Figure 3A:
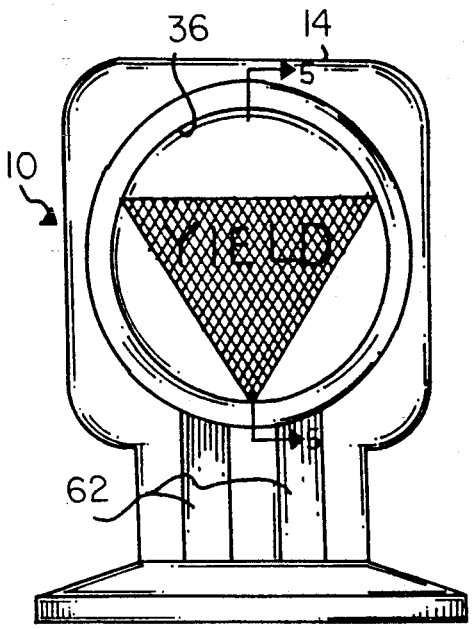
FIG. 3A is also a front elevational view similar to FIG. 3 but showing further alternate indicia.
Figure 3:
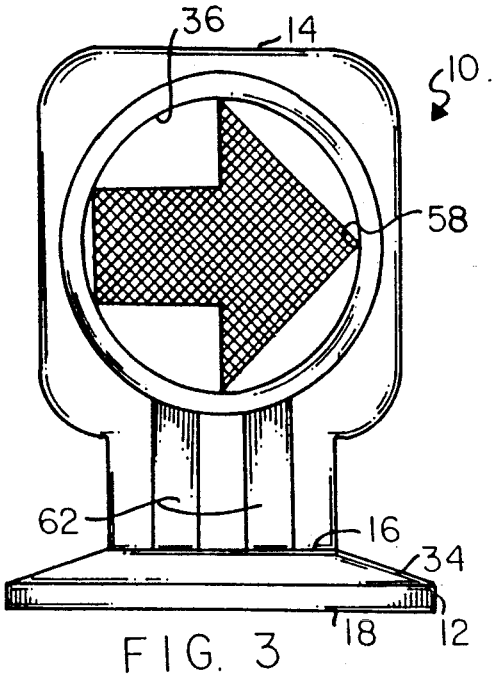
FIG. 3 is a front elevational view of the reflector of FIGS. 1 and 2 but showing alternate indicia.
Figure 4:
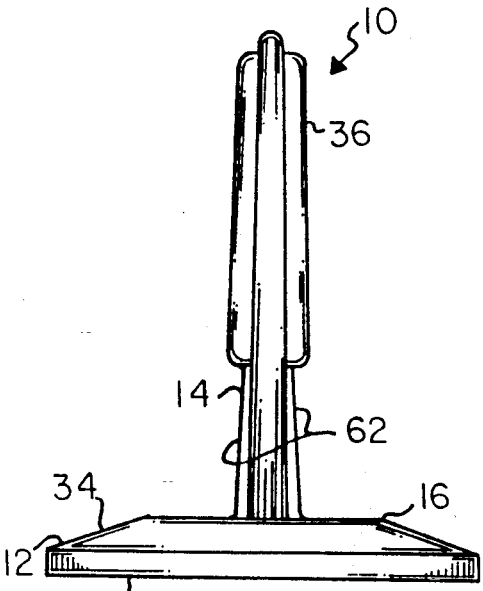
FIG. 4 is a side elevational view of the reflector of the prior Figures.

As can be seen in FIG. 2, the upper vertical component of the marker is tapered towards the edges to reduce cost to ease construction and reduce mass at the outer parameters, all of which aids in the recovery or reboundability of the device to reerect itself to a squared position perpendicular to the road surface.

Located between the bottom of each circular projection and the top face are rectangular strengthening ribs 62. The strengthening ribs give the joint between the base portion and face portion a flexible coupling.

The base portion and face portion, including the strengthening ribs, recesses and locking lip peripheries are all integrally molded from a closed cell urethane foam, molded at a temperature, and for an appropriate time, to create larger cells 66 interiorly and smaller cells exteriorly creating a higher density skin 68 than the interior. Thus, the exterior forms a hardened skin to ensure that the base maintains itself erect from the base during extended use and provides a desirable "hinge" effect at the bottom of the vertical base where it intersects with the lower horizontal base. The larger interior cells decreases its density, weight and cost. Other acceptable polymeric materials include EPDM, SBR, natural or synthetic, etc. The urethane with a durometer of about 55, plus or minus 10 percent, is preferred. In the preferred embodiment, 119 grams of material at 12 pounds per cubic foot is specifically preferred.

The integral skin means that the material is denser towards the outside and less dense in the interior. The outer skin area is closed cell urethane and the interior is a variable ratio of closed cell to open cell of approximately 60/40; 60% closed cell and 40% open cell. All are crosslinked to form the integral skin to interior integrity.

This unique construction has features that include: (1) Lower cost because of less elastomer. (2) Creates a very effective and durable hinge at the intersecton of the lower base and the upper vertical base. (3) Provides greater recovery (reboundability) to return to its original state after being crushed by vehicle tires. (4) Inherent features of the closed-cell urethane material provides an ideal product for the hostile environment such as weather, ultraviolet rays, chemical and physical abuse the product must withstand.

The design allows the device to be easily removed, by peeling the device away from the mechanical bond of the adhesive, from the road surface and then reused in a different location. The device therefore allows "semi-permanent" use for long-term construction sites but which will eventually be removed.

The use of the highway reflector will now be described. In use the device is placed upon a roadway in a location and position that is strategic for routing traffic. Strength is given to the base portion by way of its strengthening ribs. The base ribs 30 with their tapering cross section provide an enlarged surface area whereby a greater quantity of adhesive may be utilized for creating a superior grip between the roadway and the base portion. Once in place, the present device will aid in directing traffic by way of its four reflective surfaces. If the highway reflector is run over by a vehicle the face portion will bend with respect to the base portion. The nature of the material, and the strengthening ribs, enable the face portion to bend such that it is parallel to the base portion. Once a vehicle has passed over the device the face portion will erect itself such that it is once again perpendicular, 90 degrees or essentially 90 degrees, to the base portion. This design significantly enhances both the applications and lifetime of the device.

This invention has been described in its preferred form with particularity. It is understood that the present disclosure of the preferred embodiment has been made only by way of example. Numerous changes in the details of construction and combination and arrangement of parts may be made without departing from the spirit and scope of the invention.

Now that the invention has been described,

What is claimed is:

1. A highway marker comprising:

an essentially horizontally positionable base having a lower face securable to the ground and an upper face thereabove and a generally rectangular periphery therebetween, the base also having tapering exterior walls with spaced parallel ribs extending downwardly from the lower face, the ribs being formed with thinner upper end integral with the lower face and with thicker lower free ends;

an essentially vertically extending body having a generally planar front face and a generally planar rear face defining a generally rectangular periphery with a free upper edge and a lower edge integrally formed with the upper face of the base, the body being thicker at its lower edge than its upper edge;

a circular projection formed integrally with, and extending outwardly from, the front face and the rear face of the body to define recesses, the edge of each projection remote from its associated face extending radially inwardly to define a locking lip;

a plurality of ribs formed integrally with, and extending outwardly from, the front face and the rear face of the body to strengthen the body, the ribs having a generally rectangular configuration and extending between the base and an associated projection; and a circular reflector positioned in each recess and held in position by a locking lip, each reflector being formed of a circular interior component and a circular exterior component, the exterior surface of the exterior component being reflective;

the base, body, projections and ribs being molded integrally of a closed cell polyurethane foam at a temperature and time to create larger cells interiorly and smaller cells exteriorly whereby the exterior forms a hardened skin to provide a support whereby the base maintains itself erect from the base during extended use and whereby the interior imparts a reduced weight to the reflector.

2. A highway marker comprising:

an essentially horizontally positionable base having a lower face and an upper face thereabove and a periphery therebetween, the base also having tapering exterior walls with spaced parallel ribs extending downwardly from the lower face;

an essentially vertically extending body having a generally planar front face and a generally planar rear face defining periphery with a free upper edge and a lower edge integrally formed with the upper face of the base, the base being thicker at its lower edge than its upper edge;

a projection formed integrally with, and extending outwardly from, the front face and the rear face of the body to define recesses, the edge of each projection remote from its associated face extending radially inwardly to define a locking lip;

a plurality of ribs formed integrally with, and extending outwardly from, the front face and the rear face of the body to strengthen the body, the ribs extending between the base and an associated projection; and a circular reflector positioned in each recess and held in position by a locking lip, each reflector being formed of an interior component and an exterior component, the exterior surface of the exterior component being reflective.

3. The marker as set forth in claim 2 wherein the reflector has indicia on its exposed face.

4. The marker as set forth in claim 2 wherein the lip covers at least about 0.200 inches of the periphery of the marker.

5. The marker as set forth in claim 2 wherein the vertically extending body portion is molded around the majority of the reflector.

6. A highway marker comprising:

an essentially horizontal base having a lower face and an upper face thereabove and a periphery therebetween, the base also having tapering exterior walls with spaced parallel ribs extending downwardly from the lower face;

an essentially vertically extending body having a generally planar front face and a generally planar rear face defining a periphery with a free upper edge and a lower edge integrally formed with the upper face of the base, the base being thicker at its lower edge than its upper edge;

a projection formed integrally with, and extending outwardly from, the front face and the rear face of the body to define recesses;

a plurality of ribs formed integrally with, and extending outwardly from the front face and the rear face of the body to strengthen the body, the ribs extending between the base and an associated projection; and a reflector positioned in each recess, the exterior surface of the exterior component being reflective;

the base, body, projections and ribs being molded integrally of a closed cell foam at a temperature and time to create larger cells interiorly and smaller cells exteriorly whereby the exterior forms a hardened skin to provide a support whereby the base maintains itself erect from the base during extended use and whereby the interior imparts a reduced weight to the reflector.

7. The marker as set forth in claim 6 wherein the base and body are compression molded.

8. The marker as set forth in claim 6 wherein the base and body are molded of urethane.

9. The marker as set forth in claim 6 wherein the base and body are molded with curved edges.

10. The marker as set forth in claim 9 wherein the curved edges have a radius of curvature of at least about 0.250 inches.

11. The marker as set forth in claim 6 wherein the foam is selected from the class of materials including EPDM, SBR and urethane.

12. The marker as set forth in claim 6 wherein the foam is urethane.

* * * * *